US010870189B2

(12) United States Patent
Lam et al.

(10) Patent No.: US 10,870,189 B2
(45) Date of Patent: Dec. 22, 2020

(54) PERCUSSION MECHANISM DEVICE, IN PARTICULAR FOR AN IMPACT WRENCH

(71) Applicant: Robert Bosch GmbH, Stuttgart (DE)

(72) Inventors: Chian Wah Lam, Penang (MY); Sim Teik Yeoh, Gelugor Penang (MY)

(73) Assignee: Robert Bosch GmbH, Stuttgart (DE)

( * ) Notice: Subject to any disclaimer, the term of this patent is extended or adjusted under 35 U.S.C. 154(b) by 213 days.

(21) Appl. No.: 15/547,646

(22) PCT Filed: Dec. 30, 2015

(86) PCT No.: PCT/EP2015/081387
§ 371 (c)(1),
(2) Date: Jul. 31, 2017

(87) PCT Pub. No.: WO2016/119988
PCT Pub. Date: Aug. 4, 2016

(65) Prior Publication Data

US 2018/0001447 A1 Jan. 4, 2018

(30) Foreign Application Priority Data

Jan. 29, 2015 (DE) ..... 10 2015 201 573

(51) Int. Cl.
*B25B 23/147* (2006.01)
*B25B 21/02* (2006.01)
(Continued)

(52) U.S. Cl.
CPC ..... *B25B 23/147* (2013.01); *B25B 21/026* (2013.01); *B25D 11/104* (2013.01);
(Continued)

(58) Field of Classification Search
CPC ... B25B 23/147; B25B 21/026; B25D 11/104; B25D 16/003; B25D 2211/065; B25D 2217/0003
(Continued)

(56) References Cited

U.S. PATENT DOCUMENTS 2,691,434 A 10/1954 Jimerson
2005/0199404 A1* 9/2005 Furuta ..... B25B 21/00 173/48
(Continued)

FOREIGN PATENT DOCUMENTS

CN 101618535 A 1/2010
CN 101618536 A 1/2010
(Continued)

OTHER PUBLICATIONS

International Search Report dated Apr. 6, 2016 of the corresponding International Application PCT/EP2015/081387 filed Dec. 30, 2015.

*Primary Examiner* — Chelsea E Stinson
*Assistant Examiner* — Himchan Song
(74) *Attorney, Agent, or Firm* — Norton Rose Fulbright US LLP; Gerard Messina

(57) ABSTRACT

A percussion mechanism device, in particular for an impact wrench, includes a drivable drive shaft that has at least one guide groove, an output shaft, and a percussion unit that includes an anvil coupled with the output shaft in a rotationally fixed manner, a hammer, and at least one ball. The hammer is supported via the at least one ball along the at least one guide groove on the drive shaft and includes an at least regionally concavely curved ball guidance area that has an axial clearance from the at least one ball at a radially innermost point that is greater than a radial clearance
(Continued)

between the at least one ball and a radially innermost point of a concave ball guidance area of the at least one guide groove.

11 Claims, 4 Drawing Sheets

(51) Int. Cl.
*B25D 11/10* (2006.01)
*B25D 16/00* (2006.01)

(52) U.S. Cl.
CPC ..... *B25D 16/003* (2013.01); *B25D 2211/065* (2013.01); *B25D 2217/0003* (2013.01)

(58) Field of Classification Search
USPC ..... 173/90, 48, 109, 122, 176, 213, 217
See application file for complete search history.

(56) References Cited

U.S. PATENT DOCUMENTS

2006/0090913 A1* 5/2006 Furuta ..... B25B 23/14 173/48
2007/0089891 A1 4/2007 Chen
2010/0000750 A1* 1/2010 Andel ..... B25B 21/02 173/48
2010/0071923 A1* 3/2010 Rudolph ..... B25B 21/00 173/48
2011/0315417 A1* 12/2011 Matsunaga ..... B25B 23/14 173/176
2012/0241183 A1* 9/2012 Li ..... B25B 21/00 173/48
2014/0338942 A1* 11/2014 Putney ..... B25B 21/02 173/93
2014/0367132 A1* 12/2014 Tanaka ..... B25B 21/026 173/93
2014/0374130 A1* 12/2014 Nakamura ..... B25D 11/00 173/176
2015/0336249 A1* 11/2015 Iwata ..... B25B 21/02 173/1
2018/0272510 A1* 9/2018 Muramatsu ..... B25D 11/104
2018/0297179 A1* 10/2018 Osada ..... B25B 23/1475
2019/0134800 A1* 5/2019 Kumagai ..... B25D 17/26

FOREIGN PATENT DOCUMENTS

CN 103221184 A 7/2013
CN 103538018 A 1/2014
CN 103538034 A 1/2014
CN 103862416 A 6/2014
EP 2168725 A1 3/2010

* cited by examiner

PERCUSSION MECHANISM DEVICE, IN PARTICULAR FOR AN IMPACT WRENCH

CROSS-REFERENCE TO RELATED APPLICATIONS

The present application is the national stage of International Pat. App. No. PCT/EP2015/081387 filed Dec. 30, 2015, and claims priority under 35 U.S.C. § 119 to DE 10 2015 201 573.4, filed in the Federal Republic of Germany on Jan. 29, 2015, the content of each of which are incorporated herein by reference in their entireties.

FIELD OF THE INVENTION

The present invention relates to a percussion mechanism device.

BACKGROUND

A percussion mechanism device for an impact wrench having a drivable drive shaft including a guide groove, an output shaft, and a percussion unit is already known from EP 2168725 A1, in which the percussion unit includes an anvil that is coupled with the output shaft in a rotationally fixed manner, a hammer, and a ball, the hammer being supported via the ball along the guide groove on the drive shaft. The ball and the groove are slightly deformed at a contact area during operation.

SUMMARY

The present invention is based on a percussion mechanism device, in particular for an impact wrench, including a drivable drive shaft that includes at least one guide groove; an output shaft; and a percussion unit that includes an anvil coupled with the output shaft in a rotationally fixed manner, a hammer, and at least one ball, the hammer being supported via the at least one ball along the at least one guide groove on the drive shaft.

According to an example embodiment of the present invention, the hammer includes a ball-guidance area, which is concavely curved in at least some regions and has an axial clearance from the at least one ball at a radially innermost point that is greater than a radial clearance between the at least one ball and a radially innermost point of a concave ball-guidance area of the at least one guide groove. This advantageously makes it possible to obtain a larger contact area between the at least one ball and the at least one guide groove. Thus, a pressure that is acting on the at least one ball is able to be distributed across an especially large area in an advantageous manner. A deformation of the at least one ball is advantageously able to be kept to a minimum. In an example embodiment, in contrast to the known related art, a contact area between the at least one ball and the at least one guide groove is enlarged by approximately 30% in a particularly advantageous manner. This advantageously makes it possible to extend the service life of the percussion mechanism device. In addition, a particularly high impact force is achievable.

Preferably, the radially innermost point of the curved ball-guidance area of the hammer has an axial clearance from the at least one ball that is 20% larger, especially preferably, that is 50% larger, and most particularly preferably, that is twice as large, and furthermore advantageously, that is three times as large as a radial clearance between the at least one ball and a radially innermost point of a concave ball guidance area of the at least one guide groove. In this context, a "ball guidance area" is meant to particularly denote an area that is provided for guiding the at least one ball. Preferably, the at least one ball guidance area of the guide groove has an uninterrupted curvature. In addition, the at least one ball guidance area of the guide groove is advantageously free of turning points and/or planar areas.

A "radial clearance" in this context is to be understood as a clearance in a radial direction, in particular. A "radial direction" here particularly describes a direction that extends perpendicular to the axial direction of the drive shaft. In this context, an "axial clearance" in particular is to be understood as a clearance in an axial direction, and an "axial direction" in particular is meant to denote a direction extending parallel to a main direction of rotation of the drive shaft. Thus, a large contact area is advantageously achievable between the at least one ball and the ball guidance areas, in particular when given sufficient play.

A "radially innermost point" here is meant to particularly describe a point that lies closest to a main axis of rotation about which the drive shaft executes a main rotary motion in an operating state, and/or which lies closest to a rotational axis of symmetry of the hammer and/or the drive shaft. The at least one ball is preferably in the form of a steel ball, and the at least one guide groove preferably forms a V-shaped groove. "Provided" is meant to be understood as specially configured and/or specially developed. The wording that an object is provided for a specific function in particular means that the object satisfies and/or executes this specific function in at least one application and/or operating state.

In an example embodiment of the present invention, the percussion mechanism device includes a contact-pressure unit that is provided for radially pressing the at least one ball in the direction of the at least one guide groove. This advantageously makes it possible to achieve a larger contact area between the at least one ball and the at least one guide groove. The contact-pressure unit preferably exerts a force on the at least one ball in the direction of a main axis of rotation about which the drive shaft executes a main rotary motion in an operating state.

In an example embodiment, the contact-pressure unit is provided for pressing the at least one ball into the at least one guide groove in such a way that a contact area extends across at least 2% of a ball circumference of the ball. This advantageously makes it possible to reduce a contact pressure between the ball and the at least one guide groove. The contact area preferably extends across at least 5%, especially preferably across 10%, more preferably across 20%, and furthermore preferably, across 24% of a ball circumference of the ball. In this context, a "ball circumference" is meant to be understood as a length of an imaginary great circle of the ball, in particular. A "contact area" here particularly denotes an area in which contact exists between the at least one ball and the at least one guide groove.

In addition, in an example embodiment, the contact-pressure unit includes a cylindrical inner wall against which the at least one ball is to be pressed, a diameter of the inner wall at least essentially corresponding to twice the ball diameter plus a smallest possible thickness of the drive shaft in the region of the at least one guide groove. In this way, the contact-pressure unit is able to have an especially simple design from the aspect of its construction. "At least essentially," in this context, is to denote a deviation of less than 0.5 mm, but the deviation is preferably less than 100 μm, particularly preferably less than 50 μm, even more preferably less than 10 μm, and even more preferably less than 5 μm. A ratio between twice the ball diameter plus a smallest possible thickness of the drive shaft to the diameter of the inner wall in the region of the at least one guide groove that is greater than 0.99 is advantageous. A ratio greater than 0.999 is especially preferable, and a ratio greater than 0.9999 is most particularly preferable.

In addition, in an example embodiment, the at least one ball guidance area of the hammer is provided for transmitting a radial contact pressure to the at least one ball. This allows for a particularly uncomplicated pressure on the at least one ball. The at least one ball guidance area of the hammer is preferably developed as a concavely curved area.

In another further development of the present invention, in an example embodiment, the percussion mechanism device includes at least one spring-force element that is provided for exerting the radial contact pressure on the at least one ball via the at least one ball guidance area of the hammer. In this way, it is possible to achieve a particularly high contact pressure at a low constructional outlay. The spring-force element preferably forms a coil spring. The spring-force element is preferably provided for exerting a spring force on the hammer relative to the drive shaft, the spring force running parallel to the main direction of rotation of the drive shaft.

In addition, it is proposed that the hammer includes a ball guidance area that includes at least one axial elevation when viewed in the circumferential direction. This achieves a particularly low-wear coupling of the drive shaft relative to the hammer during a non-impact operation. Preferably, at least two axial elevations form a central depression of the ball guidance area of the hammer. In addition, the ball guidance area of the hammer advantageously forms at least two convex sub-areas that are connected to each other via a concave sub-area.

Furthermore, it is provided that the drive shaft includes at least two guide grooves and that the percussion unit has at least two balls that are supported within the at least two guide grooves in at least one operating state. In this way, it is advantageously possible to distribute a contact pressure to a particularly large contact area. The at least two guide grooves are preferably disposed at a 180° offset from one another in the circumferential direction.

In addition, it is proposed that the at least one guide groove has a semicircular groove base. In this way, a particularly large contact area is able to be achieved between the at least one ball and the at least one guide groove. A radial extension of the at least one guide groove is preferably greater than a ball radius of the at least one ball.

An example embodiment of the present invention is directed to an impact wrench that includes a percussion mechanism device as described herein. The impact wrench is advantageously designed to be operated with the aid of a rechargeable battery. Particularly preferably, the impact wrench forms a rotary percussive wrench or a rotary percussive wrench having a rechargeable battery.

In this context, the percussion mechanism device according to the present invention is not to be restricted to the afore-described use and embodiment. In particular, in order to satisfy an operating principle described herein, a number of the individual elements, components, and units of the percussion mechanism device according to the present invention can deviate from the number described herein.

Additional advantages result from the following description of the drawing. The drawings show an exemplary embodiment of the present invention. The drawings, description, and claims encompass numerous features in combination. For practical reasons, one skilled in the art will also examine the features individually and combine them into meaningful further combinations.

DETAILED DESCRIPTION

Figure 1:
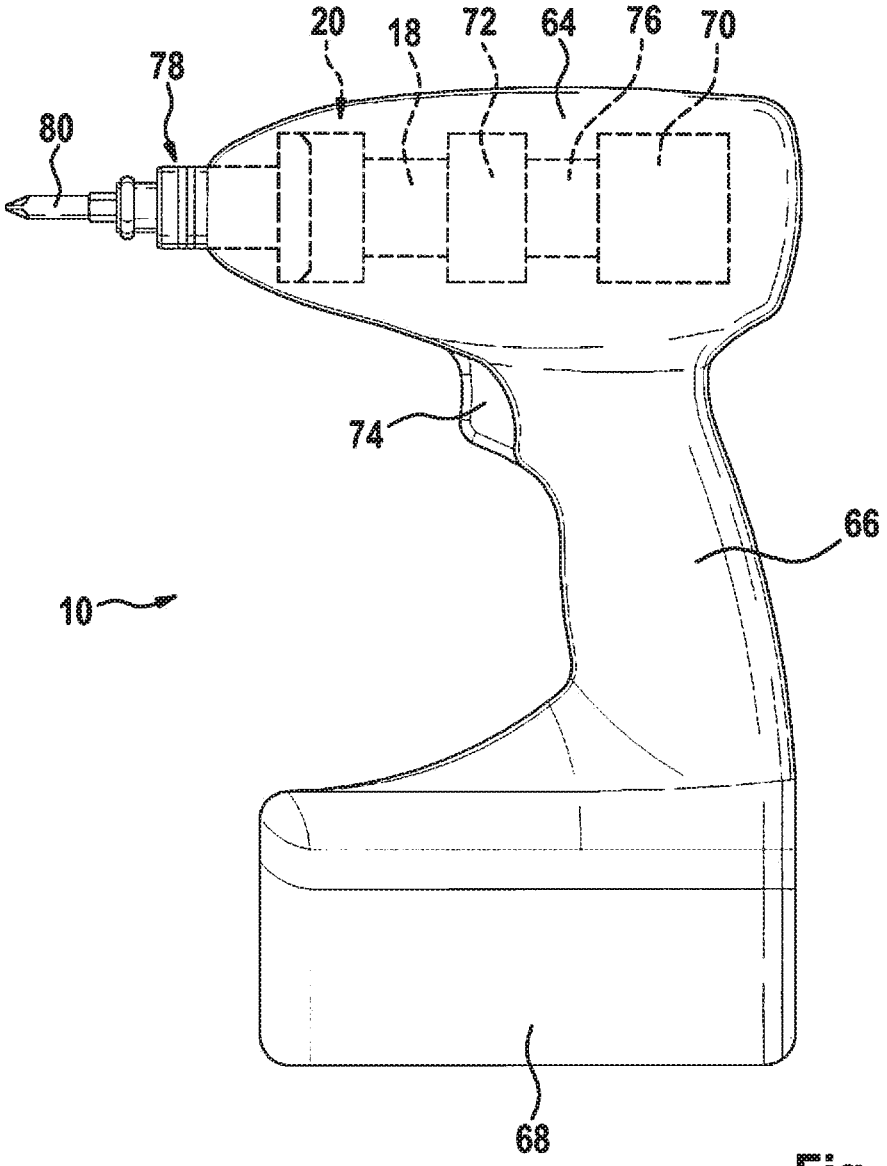
FIG. 1 is a schematic lateral view of an impact wrench that a percussion mechanism device, according to an example embodiment of the present invention.

FIG. 1 shows a handheld machine tool, which is developed as an impact wrench 10. Impact wrench 10 has a housing 64 that includes a handle 66. Impact wrench 10 has a percussion mechanism device. For a mains-independent current supply, impact wrench 10 is mechanically and electrically connectable to an accumulator battery 68. By way of example, impact wrench 10 is developed as a battery-powered rotary percussive impact wrench. It is pointed out, however, that the present invention is not restricted to battery-powered rotary percussive impact wrenches but can also be used instead in different developments of impact wrenches, regardless of whether the corresponding impact wrench is operable in a cordless or a wired manner. In addition, it is pointed out that the present invention is not restricted to motor-operated impact wrenches but can generally be used in tools in which the impact mechanism device illustrated in the following figures is able to be used.

The percussion mechanism device is situated within housing 64. In addition, an electric drive motor 70 supplied with current from accumulator battery 68, a gear unit 72, and a percussion unit 20 of the percussion mechanism device are situated inside housing 64. For example, drive motor 70 is operable, e.g., is able to be switched on and off, via a hand switch 74. Drive motor 70 can be any type of motor such as an electronically commutated motor or a DC motor. Drive motor 70 is able to be electronically controlled and/or regulated in such a way that both a reversing operation and specifications with regard to a desired rotational speed are adjustable. The operating principle and the structure of a suitable drive motor 70 are sufficiently known from the related art, so that a further description is omitted. Via an associated motor shaft 76, drive motor 70 is connected to gear unit 72, which converts a rotation of motor shaft 76 into a rotary motion of a drivable drive shaft 12 of the percussion mechanism device provided between gear unit 72 and percussion unit 20. This conversion preferably takes place in such a way that drive shaft 12 rotates at an increased torque but at a reduced rotational speed relative to motor shaft 76.

The percussion mechanism device forms a rotation and/or rotary percussion device. Percussion unit 20 is provided to generate impact-type rotary pulses of high intensity and to transmit them to an output shaft 18 of the percussion mechanism device. A tool holder 78, which is developed to accommodate inserted tools, is provided on output shaft 18. Tool holder 78 is able to be connected both to an inserted tool having an external coupling such as a screw bit, and to an inserted tool having an internal coupling such as a socket wrench. In this particular exemplary embodiment, tool holder 78 is connectable to an inserted tool 80 having an external polygonal coupling.

Figure 2:
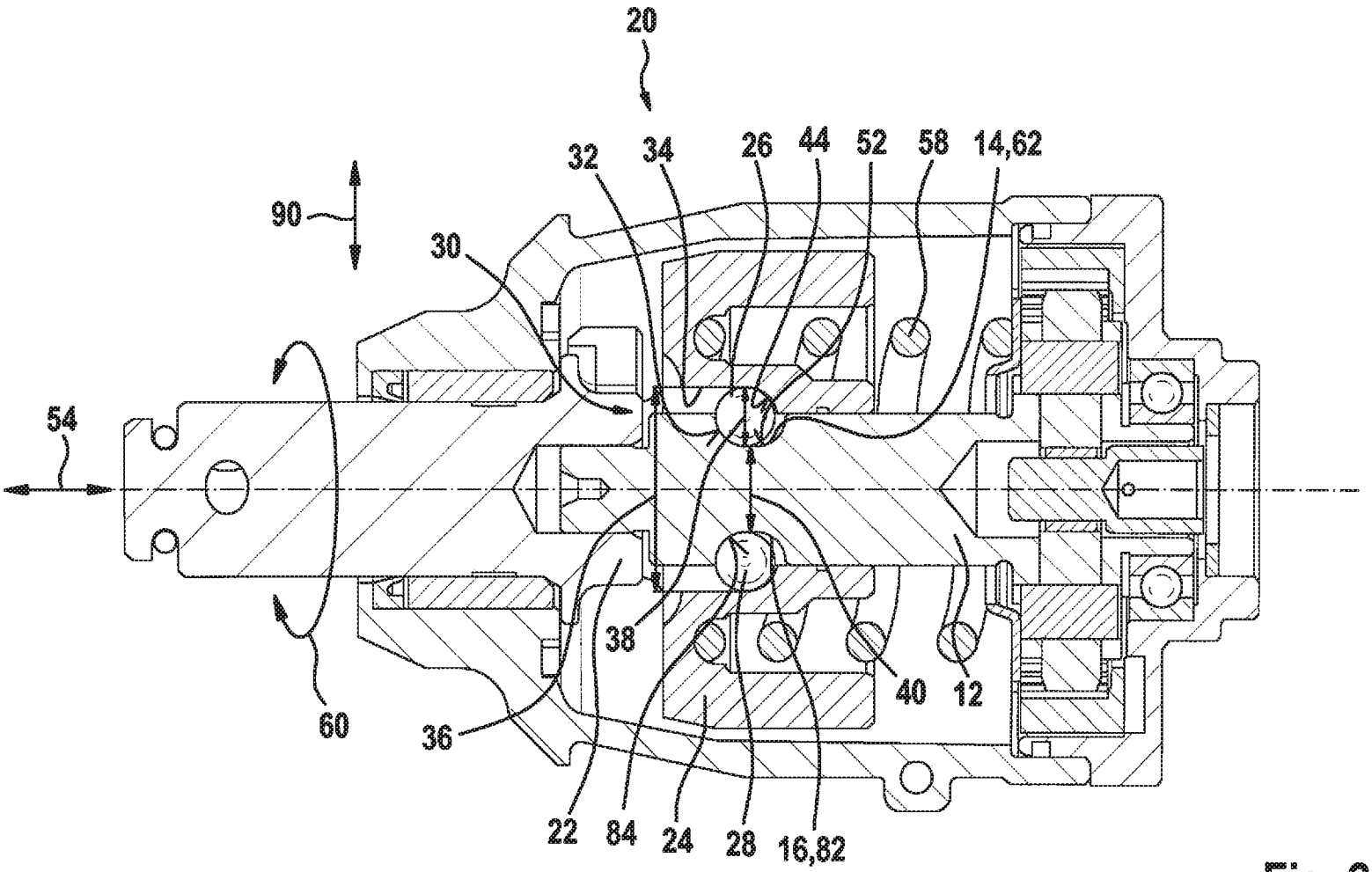
FIG. 2 is a sectional view of the percussion mechanism device according to an example embodiment of the present invention.

FIG. 2 shows the percussion mechanism device in greater detail. Drive shaft 12 includes two guide grooves 14, 16, each guide groove 14, 16 having a respective semicircular groove base 62, 82. Respective groove base 62, 82 deviates from an exact semi-circle. Percussion unit 20 has two balls 26, 28 that are guided in one of guide grooves 14, 16 in each case. Each guide groove 14, 16 thus forms a ball guidance area 52, 84. Balls 26, 28 are formed as steel balls. A radius of curvature of respective groove base 62, 82 is slightly larger than a ball radius of balls 26, 28. In other words, a radial extension of respective guide groove 14, 16 is greater than a ball radius of respective ball 26, 28. Thus, theoretically, balls 26, 28 rest against ball guidance areas 52, 84 at only one point.

Grooves 14, 16 extend in a main extension both in an axial direction 54 of drive shaft 12 and in a circumferential direction 60 of drive shaft 12. Respective groove 14, 16 has a V-shape in the respective main extension. Axial direction 54 extends parallel to a main direction of rotation of drive shaft 12. Since guide grooves 14, 16 and balls 26, 28 have an identical design, only the development of the region around the upper guide groove 14, shown in FIG. 2, and ball 26 will be referred to in the following text for the sake of simplicity.

Figure 3:
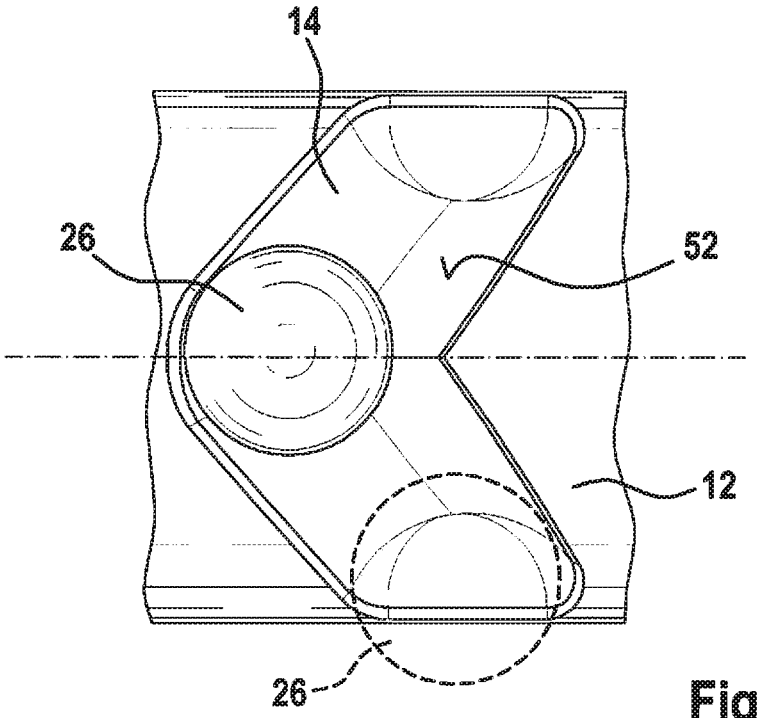
FIG. 3 is a detail view of the drive shaft of the percussion mechanism device in a detail view according to an example embodiment of the present invention.

For the transmission of strikes, percussion unit 20 has an anvil 22, which is connected to output shaft 18 in a rotationally fixed manner. In this view, anvil 22 extends perpendicular to the sectional plane and is therefore not fully visible. In addition, percussion unit 20 includes a hammer 24, which has a cylindrical design. In addition, hammer 24 and drive shaft 12 are situated coaxially with respect to each other. Via ball 26, hammer 24 is supported along guide groove 14 on drive shaft 12. Hammer 24 is able to be moved to a limited extent relative to drive shaft 12 in axial direction 54. In addition, hammer 24 is able to be rotated to a restricted extent relative to drive shaft 12 about a main axis of rotation that extends parallel to axial direction 54. Hammer 24 has a ball guidance area 44 for the guidance of ball 26. Ball guidance area 44 has a regionally concavely curved design. A radius of curvature of ball guidance area 44 is greater than a ball radius of ball 26. Theoretically, ball 26 thus rests against ball guidance area 44 of hammer 24 only at a contact point. As illustrated in FIG. 3, ball 26 is movably supported within guide groove 14.

The percussion mechanism device includes a contact-pressure unit 30, which is provided for radially pressing ball 26 in the direction of guide groove 14. This creates a contact area 32 around the theoretical contact point due to a deformation of ball 26 and guide groove 14. Contact-pressure unit 30 is provided to press ball 26 into guide groove 14 in such a way that contact area 32 extends across at least 2% of a ball circumference of ball 26. Contact-pressure unit 30 includes a cylindrical inner wall 34, against which ball 26 is to be pressed. A diameter 36 of inner wall 34 essentially corresponds to twice a ball diameter 38 of ball 26 plus a smallest possible thickness 40 of drive shaft 12 in region 42 of guide groove 14. To put it more precisely: diameter 36 is greater by less than 5 μm than twice the ball diameter 38 of ball 26 plus the smallest possible thickness 40 of drive shaft 12 in region 42 of guide groove 14. A ratio of twice the ball diameter 38 plus the smallest possible thickness 40 of drive shaft 12 to diameter 36 of inner wall 34 in region 42 of guide groove 14 is greater than 0.9999.

Figure 4:
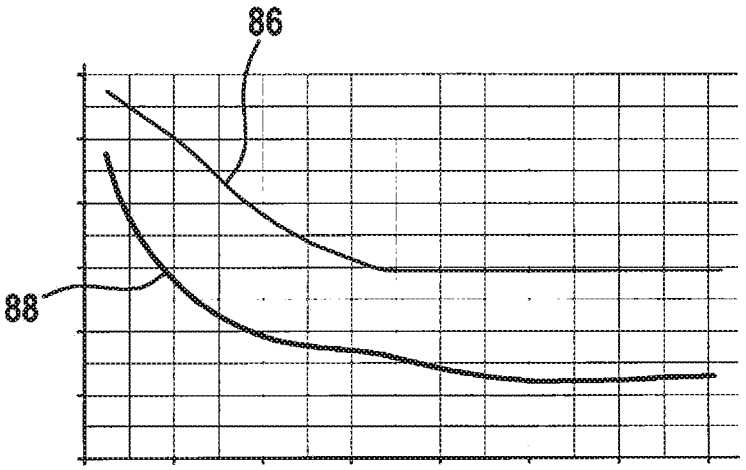
FIG. 4 is a diagram that illustrates information about a contact pressure in relation to an axial offset according to an example embodiment of the present invention in comparison to contact pressures of other devices.

In contrast to the known related art, contact area 32 between ball 26 and guide groove 14 is able to be enlarged by approximately 30%. FIG. 4 shows a curve of a total force that is generated through the contact of ball 26 in guide groove 14 in relation to an axial offset. The ordinate axis represents the total force. The abscissa axis represents the axial offset of hammer 24 during an operation. The curve of the total force from a known percussion mechanism device is shown in upper line 86. The small contact area in the related art results in overall higher loading forces than in lower line 88, which illustrates the total force in the percussion mechanism device according to the present invention.

Percussion mechanism device includes a spring-force element 58. Spring-force element 58 is provided to exert the radial contact pressure on ball 26 via ball guidance area 44 of hammer 24. Spring-force element 58 forms a coil spring. Spring-force element 58 is provided to exert a spring force on hammer 24 relative to drive shaft 12, the spring force running parallel to axial direction 54 of drive shaft 12. Hammer 24 includes a ball guidance area 44 that includes two axial elevations when viewed in a circumferential direction 60. The two axial elevations form a central depression of ball guidance area 44 of hammer 24. Ball guidance area 44 of hammer 24 thereby creates two convex sub-areas, which are interconnected via a concave sub-area. Ball guidance area 44 of hammer 24 is provided for transmitting the radial contact pressure to ball 26. Ball guidance area 44 of hammer 24 is regionally developed in a concavely curved manner.

Figure 5:
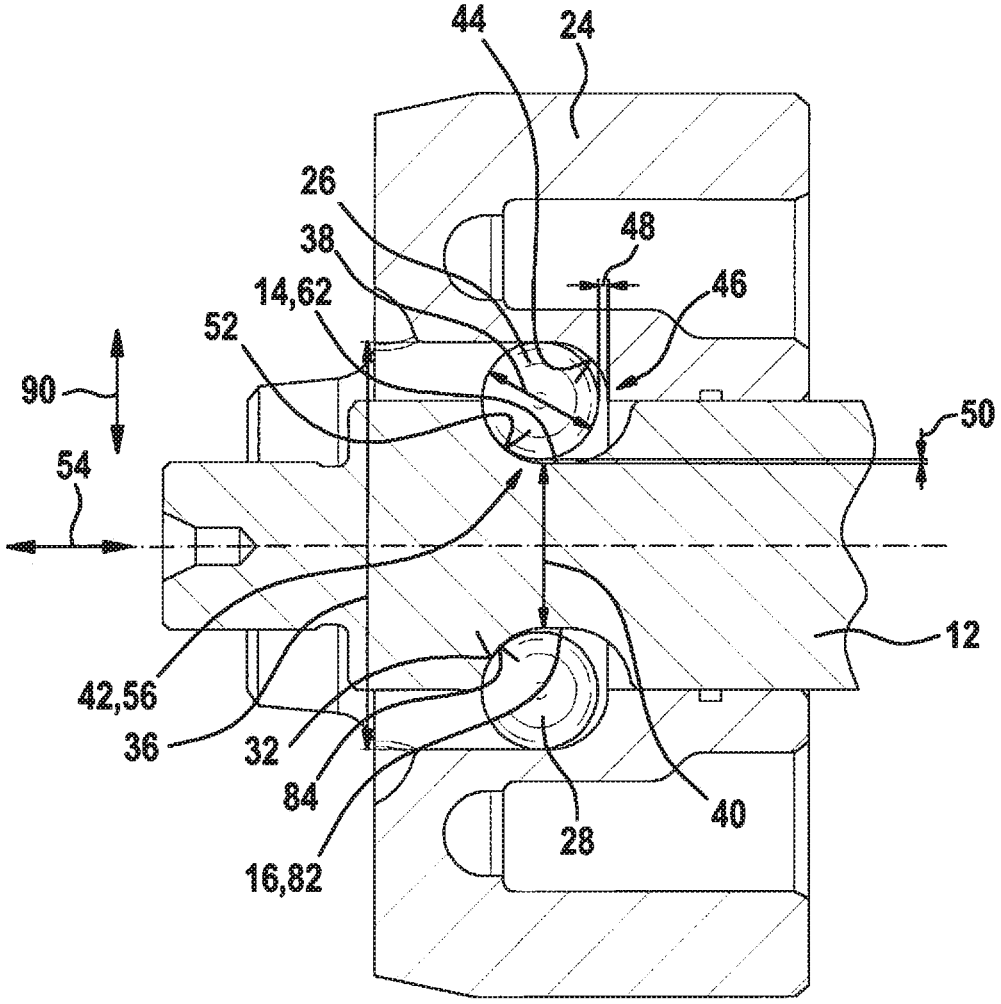
FIG. 5 is a detail view of the drive shaft, a hammer of the percussion mechanism device, and two balls according to an example embodiment of the present invention.

As shown in greater detail in FIG. 5, regionally concavely curved ball guidance area 44 of hammer 24 has an axial clearance 48 from ball 26 at a radially innermost point that is greater than a radial clearance 50 between ball 26 and a radially innermost point of concave ball guidance area 52 of guide groove 14. Put another way, in an operating state, concavely curved ball guidance area 44 of hammer 24 has an axial clearance 48 at a region 46 extending parallel to a radial direction 90 of drive shaft 12 with respect to ball 26 that is greater than a radial clearance 50 between ball 26 and concave ball guidance area 52 of guide groove 14 in a region 56 extending parallel to axial direction 54. Axial clearance 48 from the radially innermost point of curved ball guidance area 44 is more than three times as large as radial clearance 50 between ball 26 and the radially innermost point of concave ball guidance area 52 of guide groove 14, 16.

What is claimed is:

1. A percussion mechanism device comprising:

a drivable drive shaft that includes at least one guide groove;

an output shaft; and a percussion unit that includes:

an anvil coupled in a rotationally fixed manner with the output shaft;

a hammer; and at least one ball, wherein the hammer:

is supported via the at least one ball along the at least one guide groove on the drive shaft; and includes an at least regionally concavely curved ball guidance area that has an axial clearance in a direction toward a drive motor from the at least one ball at a radially innermost point that is greater than a radial clearance between the at least one ball and a radially innermost point of a concave ball guidance area of the at least one guide groove when the at least one ball is in a foremost position of the at least one guide groove and the hammer is in a foremost position, wherein the axial clearance from the radially innermost point of the concavely curved ball guidance area is more than three times as large as the radial clearance between the at least one ball and the radially innermost point of the concave ball guidance area of the at least one guide groove.

2. The percussion mechanism device of claim 1, wherein the at least one ball is arranged for a contact-pressure surface to radially press the at least one ball toward the at least one guide groove.

3. The percussion mechanism device of claim 2, wherein the contact-pressure surface includes a cylindrical inner wall against which the at least one ball can be pressed, and a diameter of the inner wall corresponds at least to twice a diameter of the at least one ball plus a smallest thickness of the drive shaft in a region of the at least one guide groove.

4. The percussion mechanism device of claim 1, wherein the at least one ball is arranged for a contact-pressure surface to radially press the at least one ball toward the at least one guide groove in such a way that a contact area of the at least one ball with the at least one guide groove extends across at least 2% of a ball surface of the at least one ball.

5. The percussion mechanism device of claim 1, wherein the at least one ball guidance area of the hammer is arranged to transmit a radial contact pressure to the at least one ball.

6. The percussion mechanism device of claim 5, further comprising at least one spring-force element arranged to exert the radial contact pressure on the at least one ball via the at least one ball guidance area of the hammer.

7. The percussion mechanism device of claim 1, wherein the ball guidance area has at least one elevated profile when viewed in a circumferential direction.

8. The percussion mechanism device of claim 1, wherein the at least one guide groove includes at least two guide grooves and the at least one ball includes at least two balls that are supported within the guide grooves at least in an operating state.

9. The percussion mechanism device of claim 1, wherein the at least one guide groove includes a semicircular groove base.

10. The percussion mechanism device of claim 1, wherein the percussion mechanism device is for an impact wrench.

11. An impact wrench comprising a percussion mechanism device, the percussion mechanism device including:

a drivable drive shaft that includes at least one guide groove;

an output shaft; and a percussion unit that includes:

an anvil coupled in a rotationally fixed manner with the output shaft;

a hammer; and at least one ball, wherein the hammer:

is supported via the at least one ball along the at least one guide groove on the drive shaft; and includes an at least regionally concavely curved ball guidance area that has an axial clearance in a direction toward a drive motor from the at least one ball at a radially innermost point that is greater than a radial clearance between the at least one ball and a radially innermost point of a concave ball guidance area of the at least one guide groove when the at least one ball is in a foremost position of the at least one guide groove and the hammer is in a foremost position, wherein the axial clearance from the radially innermost point of the concavely curved ball guidance area is more than three times as large as the radial clearance between the at least one ball and the radially innermost point of the concave ball guidance area of the at least one guide groove.

* * * * *